US011719205B2

(12) United States Patent
Cathcart et al.

(10) Patent No.: US 11,719,205 B2
(45) Date of Patent: Aug. 8, 2023

(54) FUEL INJECTION SYSTEM

(71) Applicant: ORBITAL AUSTRALIA PTY LTD, Balcatta (AU)

(72) Inventors: Geoffrey Paul Cathcart, Mount Lawley (AU); Stephen John Karay, Scarborough (AU); David James Caley, City Beach (AU)

(73) Assignee: Orbital Australia Pty Ltd

( * ) Notice: Subject to any disclaimer, the term of this patent is extended or adjusted under 35 U.S.C. 154(b) by 48 days.

(21) Appl. No.: 16/087,209

(22) PCT Filed: Mar. 23, 2017

(86) PCT No.: PCT/AU2017/050261
§ 371 (c)(1),
(2) Date: Sep. 21, 2018

(87) PCT Pub. No.: WO2017/161422
PCT Pub. Date: Sep. 28, 2017

(65) Prior Publication Data

US 2019/0101088 A1 Apr. 4, 2019

(30) Foreign Application Priority Data

Mar. 23, 2016 (AU) ..... 2016901091

(51) Int. Cl.
*F02M 55/00* (2006.01)
*F02M 61/14* (2006.01)
(Continued)

(52) U.S. Cl.
CPC ..... *F02M 55/008* (2013.01); *F02M 19/03* (2013.01); *F02M 55/00* (2013.01);
(Continued)

(58) Field of Classification Search
CPC ..... F02M 19/03; F02M 55/00; F02M 55/008; F02M 61/14; F02M 67/02; F02M 69/16; F02M 71/00
(Continued)

(56) References Cited

U.S. PATENT DOCUMENTS 2,630,304 A * 3/1953 Rivoche ..... F02M 1/00 137/865
4,359,025 A 11/1982 Zeliszkewycz
(Continued)

FOREIGN PATENT DOCUMENTS

EP 2379855 A1 10/2011
FR 1358593 A 4/1964
(Continued)

OTHER PUBLICATIONS

International Search Report for PCT/AU2017/050261, ISA/AU, Woden ACT, dated Jun. 7, 2017.
(Continued)

*Primary Examiner* — Hai H Huynh
*Assistant Examiner* — Johnny H Hoang
(74) *Attorney, Agent, or Firm* — Harness, Dickey & Pierce PLC

(57) ABSTRACT

A dual fluid injection system which comprises a liquid fuel metering device, a fluid delivery device, and apparatus providing an interface therebetween. The interface conveys liquid fuel along a flow path from the metering device to a mixing zone for mixing with air from a pressurized supply to provide an air-fuel mixture for injection by the fluid delivery device into a combustion chamber of an internal combustion engine. The flow path may involve a directional change by way of a turn section. The flow path is sized such that liquid fuel is retained therein by virtue of capillary action, whereby a quantity of liquid fuel is retained after a
(Continued)

delivery event such that the flow path remains substantially filled with liquid fuel in readiness for the next delivery event during operation of the engine.

19 Claims, 7 Drawing Sheets

(51) Int. Cl.

| | |
|---|---|
| ***F02M 67/02*** | (2006.01) |
| ***F02M 69/16*** | (2006.01) |
| ***F02M 19/03*** | (2006.01) |
| ***F02M 71/00*** | (2006.01) |
| *F02M 57/00* | (2006.01) |
| *F02M 69/04* | (2006.01) |

(52) U.S. Cl.
CPC ..... *F02M 61/14* (2013.01); *F02M 67/02* (2013.01); *F02M 69/16* (2013.01); *F02M 71/00* (2013.01); *F02M 57/00* (2013.01); *F02M 69/047* (2013.01); *F02M 2200/856* (2013.01)

(58) Field of Classification Search
USPC ..... 123/470
See application file for complete search history.

(56) References Cited

U.S. PATENT DOCUMENTS

| | | | | |
|---|---|---|---|---|
| 4,800,862 | A | 1/1989 | McKay et al. | |
| 4,823,756 | A * | 4/1989 | Ziejewski | F02M 51/00 239/404 |
| 4,934,329 | A | 6/1990 | Lear et al. | |
| 5,095,873 | A * | 3/1992 | Motoyama | F02D 31/008 123/305 |
| 5,170,766 | A | 12/1992 | Haas et al. | |
| 6,109,536 | A * | 8/2000 | English | F02M 47/027 239/5 |
| 6,161,525 | A * | 12/2000 | Ficht | F02B 23/101 123/495 |
| 6,564,770 | B1 | 5/2003 | Cathcart | |
| 6,913,005 | B2 * | 7/2005 | Linna | F02D 41/003 123/549 |
| 2002/0002967 | A1 * | 1/2002 | Paul | F02M 49/02 123/304 |
| 2007/0158451 | A1 * | 7/2007 | Mao | B01F 3/04049 239/13 |
| 2010/0043758 | A1 * | 2/2010 | Caley | F02D 41/20 123/490 |
| 2012/0216773 | A1 * | 8/2012 | Brewster | F02B 43/00 123/299 |
| 2013/0175365 | A1 * | 7/2013 | Ergut | F23D 14/22 239/407 |
| 2014/0246508 | A1 | 9/2014 | Caley et al. | |
| 2014/0299671 | A1 * | 10/2014 | Lull | F02M 61/162 239/5 |
| 2016/0017845 | A1 * | 1/2016 | Huang | F02M 21/0209 290/1 A |
| 2016/0222936 | A1 * | 8/2016 | Helsel | F02B 43/00 |

FOREIGN PATENT DOCUMENTS

| | | | |
|---|---|---|---|
| GB | 2246165 | A | 1/1992 |
| GB | 2348669 | A | 10/2000 |
| WO | WO-2004/081370 | A1 | 9/2004 |
| WO | WO-2013/181718 | A1 | 12/2013 |

OTHER PUBLICATIONS

Written Opinion of the ISA for PCT/AU2017/050261, ISA/AU, Woden ACT, dated Jun. 7, 2017.
Extended European Search Report from Application No. 17769191.2 dated Oct. 17, 2019.
International Preliminary Report on Patentability for PCT/AU2017/050261, IPEA/AU, Woden ACT, with annexes, dated Mar. 15, 2018.

* cited by examiner

FUEL INJECTION SYSTEM

CROSS-REFERENCE TO RELATED APPLICATIONS

This application is a 371 U.S. National Stage of International Application No. PCT/AU2017/050261, filed Mar. 23, 2017, which claims priority to Australian Patent Application No. 2016901091, filed Mar. 23, 2016. The entire disclosures of both of the above applications are incorporated herein by reference.

TECHNICAL FIELD

This invention relates to mixing a liquid fuel with air for use with dual fluid injection systems for internal combustion engines. More particularly, the invention concerns apparatus and methods for mixing a liquid fuel with air in a dual fluid injection system for an internal combustion engine. The invention also relates to a dual fluid injection system for an internal combustion engine.

The invention has been devised particularly, although not necessarily solely, for use with small, reciprocating piston two-stroke engines of the type used on unmanned aerial vehicles (UAVs) and snowmobiles, although it can of course also be used on any other appropriate internal combustion engine.

BACKGROUND ART

The following discussion of the background art is intended to facilitate an understanding of the present invention only. The discussion is not an acknowledgement or admission that any of the material referred to is or was part of the common general knowledge as at the priority date of the application.

The discussion is provided in the context of a small, reciprocating piston two-stroke engine of the type used on unmanned aerial vehicles (UAVs) and snowmobiles, although the invention may have application to other internal combustion engines, as would be understood by a person skilled in the art.

Engines for UAVs and snowmobiles may be required to operate in adverse conditions; for example, UAV engines may be required to operate in high altitude conditions, and snowmobile engines may be required to operate in sub-zero ambient conditions.

Engines for UAVs and snowmobiles also have certain packaging constraints; for example, there are likely to be packaging constraints associated with space and weight limitations for an engine adapted for use with a UAV.

There may be various operational and economic advantages realisable from fueling such engines by way of a dual fluid direct injection system. However, a dual fluid direct injection system typically requires a fuel injector and a delivery injector operating in tandem. Typically, the fuel injector and the delivery injector are axially aligned in the tandem arrangement, with the fuel injector commonly being "piggybacked" onto the delivery injector. While such an arrangement is suitable for many applications, this arrangement can present particular challenges in relation to engines for UAVs and snowmobiles where the vehicles are likely to experience adverse operating conditions and where the engines for these vehicles will have to satisfy certain packaging constraints. Such packaging constraints may for example include a defined limit to the frontal area or height of the engine when the fuel injection system is arranged on the engine.

With a view to addressing such challenges, the present Applicant has proposed improvements to fuel injection systems as disclosed in WO 2013/181718, the contents of which are incorporated herein by way of reference. One aspect of the improvements proposed involved an arrangement in which a fuel injector is positioned laterally with respect to a delivery injector to provide a dual fluid injection assembly, thereby reducing the overall height of the assembly and positioning of the fuel injector closer to the engine. As discussed in WO 2013/181718, the reduction in overall height of the assembly is considered to be beneficial in terms of packaging, and positioning of the fuel injector closer to the engine is considered to be beneficial in terms of warming of the fuel, which may facilitate use of so-called heavy fuels such as kerosene and jet fuel.

The arrangement proposed in WO 2013/181718 requires an elbow or corner in a flow path between the fuel injector and the delivery injector, with liquid fuel delivered by the fuel injector immediately being entrained in air flowing along the flow path to the delivery injector. More particularly, the fuel injector delivers liquid fuel into a section of the flow path upstream of the bend or elbow. With this arrangement, the liquid fuel is mixed with air immediately upon leaving the fuel injector, with the fuel then being transported around the bend or elbow entrained in air.

The requirement for the liquid fuel to be conveyed along the flow path entrained in air would typically require high air demand to satisfactorily transport and scavenge fuel around the corner or elbow. However, the requisite high air demand might not necessarily be available for certain engines and applications, such as those related to UAVs and snowmobiles, where packaging constraints may limit access to sufficient air flow. The requirement for the liquid fuel to be conveyed along the flow path entrained in air may also present issues around "wall wetting" and "fuel hang-up", which could potentially lead to fuel delivery issues and problems ultimately affecting engine performance.

It is against this background that the present invention has been developed. However, it should be understood that the invention need not be limited to a dual fluid injection system featuring a fuel injector positioned laterally with respect to a delivery injector. In particular, the invention contemplates a dual fluid injection system featuring a fuel injector positioned in other arrangements with respect to a delivery injector, including for example an axial arrangement.

SUMMARY OF INVENTION

According to a first aspect of the invention there is provided an apparatus for mixing a liquid fuel with air for use with a dual fluid injection system for an internal combustion engine, the apparatus comprising an inlet for receiving a metered quantity of liquid fuel, a flow path extending from the inlet for transporting liquid fuel received at the inlet to a mixing zone at which liquid fuel is admitted into a volume of air to create an air-fuel mixture, the flow path having an inlet end communicating with the inlet and an outlet end communicating with the mixing zone, wherein the flow path is configured to convey liquid fuel received at the inlet end and to discharge liquid fuel at the outlet end into the mixing zone, the flow path being configured such that the volume of liquid fuel discharging at the outlet end corresponds to the volume of the metered quantity of liquid fuel received at the inlet, wherein the flow path is sized to retain liquid fuel therein by capillary action whereby the flow path remains substantially filled with liquid fuel between delivery cycles, and wherein the flow path comprises a directional change between the inlet end and the outlet end.

The mixing zone may communicate with a fluid delivery device, whereby the fluid delivery device is operable to deliver the air-fuel mixture directly into a combustion space.

The mixing zone may be defined wholly or in part by the fluid delivery device, or it may be separate from the fluid delivery device. Typically, the mixing zone is incorporated in the fluid delivery device and is thereby defined wholly by the fluid delivery device.

The air for mixing with the fuel at or within the mixing zone may comprise pressurised air received from an air supply.

Preferably, the flow path is sealed, apart from the inlet end and the outlet end.

The flow path may be sized to retain liquid fuel therein by capillary action, by either so sizing the entire flow path between the inlet and the outlet or so sizing only a portion of the flow path adjacent the outlet end.

Because the flow path is sized such that liquid fuel is retained within the flow path by virtue of capillary action, the flow path, or at least a portion thereof adjacent the outlet end, serves to retain liquid fuel after a metering event (in which liquid fuel is delivered into the mixing zone), such that the flow path remains substantially filled with liquid fuel in readiness for the next metering event during operation of the engine.

Because the flow path remains substantially filled with liquid fuel between delivery cycles, liquid fuel is retained and remains present within the flow path (at least after initial priming at engine start-up). With this arrangement, the volume of liquid fuel issuing at the outlet end is substantially equal to the volume of liquid fuel received into the flow path at the inlet end, with the volume of liquid fuel received at the inlet end serving to drive liquid flow along the flow path and to cause a corresponding quantity of liquid fuel to issue at the outlet end of the flow path. In this way, hydraulic power is utilised to transport the liquid fuel to the mixing zone for mixing with air to create the air-fuel mixture.

In this way, there is controlled delivery of liquid fuel issuing from the outlet end of the flow path into the mixing zone, the issuing liquid fuel comprising a volume equivalent to the metered quantity of liquid fuel received at the inlet. The actual quantity of fuel issuing at the outlet end is not that which is received at the inlet, but rather is at least a portion of the actual fuel retained within the flow path, supplemented to the extent that may be necessary by a portion of the liquid fuel received at the inlet.

With this arrangement, liquid fuel introduced under pressure into the inlet end of the flow path serves to drive liquid fuel already present in the flow path along the flow path and causes a corresponding metered quantity of liquid fuel to issue at the outlet end of the flow path for mixing with the air to create the air-flow mixture.

The flow path may be of constant cross-sectional flow area between the inlet end and the outlet end, or it may be of varying cross-sectional flow area. In the latter case, there may be changes in cross-sectional flow area, such as for example sections of enlarged and reduced flow area. The changes in cross-sectional flow area may arise through the presence of one or more voids in the flow path.

The flow path may comprise a plurality of path sections communicating one with another. The path sections may be of any one or more appropriate forms, including for example flow passages, galleries, ducts and voids.

Where the flow path comprises a passage, the passage may be continuous, or it may comprise a plurality of passage sections which together provide the passage.

Because of the directional change in the flow path, the inlet end and the outlet end of the flow path are offset with respect to each other. The flow path may feature a turn section which provides the directional change. The turn section may comprise a bend or an elbow. There may also be more than one turn section. By way of example, the flow path may comprise a combination of straight and turn sections. The turn section(s) may be angular (including a right-angle turn) or curved, or a combination thereof. The turn section may comprise a continuous curve. A flow path comprising only a turn section (and nothing else) is also contemplated; for example, the flow path may be arcuate along its entire length between the inlet and outlet ends. In other words, the flow path may comprise only a curved turn section.

The inlet for receiving a metered quantity of liquid fuel may comprise an inlet portion adapted to receive a liquid fuel metering device. The liquid fuel metering device may, for example, comprise a fuel injector.

The apparatus may further comprise an outlet for communication with the fluid delivery device. The outlet may comprise an outlet portion adapted to receive the fluid delivery device. The fluid delivery device may, for example, comprise a delivery injector.

With this arrangement, the apparatus may constitute an interface between the liquid fuel metering device and the fluid delivery device.

With this interface arrangement, the liquid fuel is not mixed with air immediately upon leaving the fuel injector, as is the case with prior art arrangements. Rather, there is a delay between liquid fuel leaving the fuel injector and that liquid being mixed with air to provide an air-fuel mixture, the delay arising because liquid fuel leaving the fuel injector is transported along the flow path before being mixed with air.

The presence of the flow path provides an opportunity to incorporate a directional change in the flow. This is because the flow path provides a hydraulic passage which is sealed in the sense that the volume of liquid fuel entering the passage is the same as the volume of liquid discharging from the passage. By using a hydraulic passage of this type to deliver the liquid fuel, it is possible to turn the metered liquid fuel through any angle prior to delivery through the outlet end into the mixing zone. As alluded to above, the flow path may feature one or more turn sections which provide the directional change. By way of example, the flow path may comprise a combination of straight and turn sections which cooperate to provide the overall angle through which the metered liquid fuel is turned prior to delivery through the outlet end into the mixing zone.

Known arrangements for dual fluid delivery feature a fuel injector and a delivery injector operating in tandem. Typically, the fuel injector and the delivery injector are axially aligned in the tandem arrangement, with the fuel injector commonly being "piggybacked" onto the delivery injector.

The interface between the liquid fuel metering device and the fluid delivery device provided by the present invention can facilitate such a tandem operating arrangement.

Where the flow passage is straight, the fuel injector and the delivery injector would be axially aligned in the tandem arrangement.

Where the flow passage involves a directional change, the fuel injector and the delivery injector would be angularly offset in the tandem arrangement; that is, the fuel injector could be disposed laterally with respect to the delivery injector. In a case where the turn comprises a right angle turn, the fuel injector could be normal to the delivery injector.

The apparatus may further comprise a retainer for releasably retaining the liquid fuel metering device with respect to the inlet portion. The retainer may comprise a spring which is operable to bias the liquid fuel metering device into engagement with the inlet portion. Retaining the liquid fuel metering device with respect to the inlet portion ensures that the volume between the outlet of the liquid fuel metering device and the outlet end of the flow passage is maintained constant during the metering and delivery of liquid fuel through the flow path. This ensures reliability and repeatability of liquid fuel metering events, thereby ensuring consistency in operation of the apparatus.

Typically, the liquid fuel metering device comprises a nozzle portion adapted to be received in the inlet portion.

With such an arrangement, the inlet portion may be configured as a socket portion adapted to receive a counterpart spigot portion defined by the nozzle portion of the liquid fuel metering device.

The inlet portion may be configured to provide a space defined between the inlet end of the flow path and the nozzle portion of the liquid fuel metering device when the latter is received and retained within the inlet portion.

The liquid fuel metering device is operable to deliver liquid fuel into the space, from where it can flow into the flow path via the inlet end. The space may be capable of accepting liquid fuel delivered by the liquid fuel metering device in a variety of forms; for example, a pencil or linear fuel plume, a multiple stream fuel plume issuing from a multi-hole delivery arrangement, a spray or conical fuel plume.

The inlet portion may be configured to accommodate different types of liquid fuel metering devices having different fluid delivery configurations for delivery of a variety of fuel plumes; for example, fuel plumes such as a pencil or linear fuel plume, a multiple stream fuel plume, a spray or conical fuel plume, as alluded to above.

The apparatus may further comprise a body adapted to define the inlet portion, the outlet portion and the flow path. The body may be of one-piece construction, such as a casting or machined element, or it may comprise an assembly of several parts. Where the body comprises an assembly of several parts, the flow path may be defined by a single part or by several parts in combination.

According to a second aspect of the invention there is provided a dual fluid injection system comprising an apparatus according to the first aspect of the invention.

According to a third aspect of the invention there is provided a dual fluid injection system comprising a liquid fuel metering device, a fluid delivery device, and an apparatus according to the first aspect of the invention providing an interface between the liquid fuel metering device and the fluid delivery device.

With the dual fluid injection system, the fluid delivery device is arranged to retain the air-fuel mixture and to deliver the air-fuel mixture into the combustion space.

Preferably, the dual fluid injection system is configured for direct injection into the combustion space.

The mixing zone may be at any appropriate location within the dual fluid injection system. The mixing zone may be defined wholly or in part by the fluid delivery device, or it may be separate from the fluid delivery device. Typically, the mixing zone is incorporated within the fluid delivery device and is thereby defined wholly by the fluid delivery device. With such an arrangement, the liquid fuel may be mixed with pressurised air to create the air-fuel mixture within the confines of the fluid delivery device. In other words, the mixing zone may be within the confines of the fluid delivery device, with the flow path having an interface portion extending into the fluid delivery device.

The interface portion may further comprise an extension portion adapted to extend further into the fluid delivery device. The extension portion may be configured as a slender extension tube. Where the fluid delivery device comprises a delivery injector having a delivery valve (such as a poppet valve) operable to open and close to control delivery of the air-fuel mixture from the delivery device, the extension tube may be adapted to be received in and extend along a hollow stem of the delivery valve. With this arrangement, the length of the extension tube can be selected to accord with the desired location at which the liquid fuel is to be introduced into the pressurised air. In this way, the position of the mixing zone can be selected relative to the location at which the delivery valve is opened and closed to control delivery of the air-fuel mixture.

The dual fluid injection system may further comprise a fuel rail, wherein the interface between the liquid fuel metering device and the fluid delivery device may be integrated with the fuel rail.

According to a fourth aspect of the invention there is provided a method of fueling an internal combustion engine, the method featuring use of an apparatus according to the first aspect of the invention.

According to a fifth aspect of the invention there is provided a method of fueling an internal combustion engine, the method featuring use of a dual fluid injection system according to the third aspect of the invention.

According to a sixth aspect of the invention there is provided a method of fueling an internal combustion engine, the method comprising providing a flow path having an inlet end, an outlet end and a directional change between the inlet end and outlet end, the flow path being sized to retain liquid fuel therein by capillary action whereby the flow path is configured to remain substantially filled with liquid fuel between delivery cycles, delivering a metered quantity of liquid fuel to the flow path at the inlet end, the volume of liquid fuel received at the inlet end serving to drive liquid flow along the flow path and to cause a corresponding volume of liquid fuel to issue at the outlet end of the flow path.

According to a seventh aspect of the invention there is provided a method of fueling an internal combustion engine, the method comprising transporting a metered quantity of liquid fuel around a turn section to an outlet end of a flow path sized to retain liquid fuel therein by capillary action whereby the flow path is configured to remain substantially filled with liquid fuel between delivery cycles, discharging the metered quantity of liquid fuel at the outlet end for mixing with pressurised air to create an air-fuel mixture, and delivering the air-fuel mixture into a combustion space.

Preferably, the step of transporting a metered quantity of liquid fuel around a turn section to an outlet end of a flow path comprises introducing fuel under pressure into an inlet end of the flow path for flow along the flow path around the turn section to the outlet end, the fuel introduced under pressure into an inlet end of the flow path emanating from a liquid fuel metering device operable to discharge a metered quantity of liquid fuel, the discharged metered quantity of liquid fuel driving liquid flow along the flow path and causing a corresponding metered quantity of liquid fuel to issue at the outlet end of the flow path for mixing with the air to create the air-flow mixture.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

Figure 1:
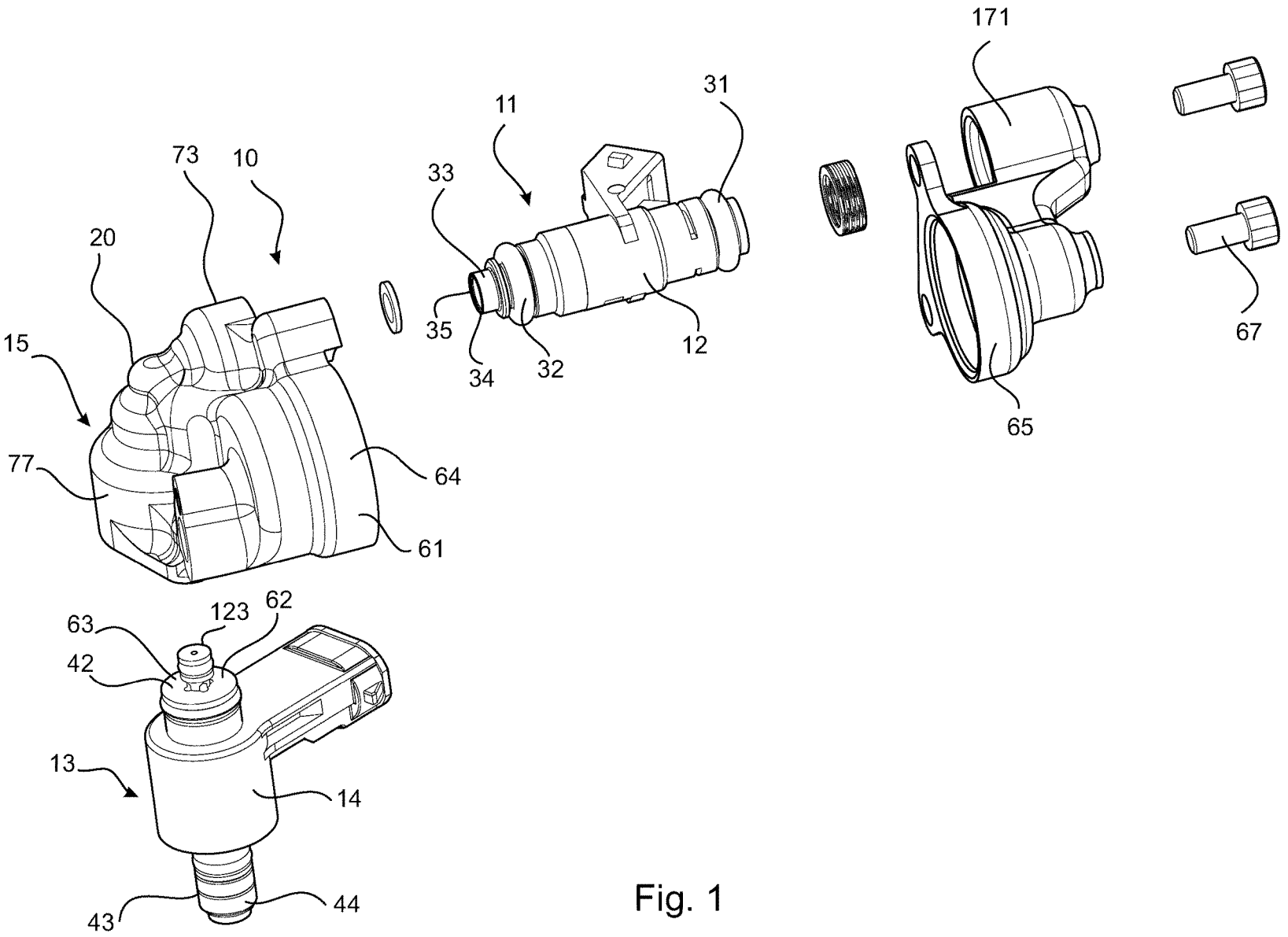
FIG. 1 is an exploded perspective view of a first embodiment featuring an assembly comprising a liquid fuel metering device, a fluid delivery device, and an interface apparatus for conveying liquid fuel received from the metering device to a mixing zone for mixing with air to provide an air-fuel mixture for injection by the fluid delivery device.

In the drawings like structures are referred to by like numerals throughout the several views. The drawings shown are not necessarily to scale, with emphasis instead generally being placed upon illustrating the principles of the present invention The figures depict several embodiments of the invention. The embodiments illustrate certain configurations; however, it is to be appreciated that the invention can take the form of many configurations, as would be obvious to a person skilled in the art, whilst still embodying the present invention. These configurations are to be considered within the scope of this invention.

DESCRIPTION OF EMBODIMENTS

The embodiments shown in the drawings are each directed to a dual fluid injection system 10 for an internal combustion engine. The dual fluid injection system 10 has been devised particularly, although not solely, for engines which are naturally aspirated, which may be required to operate in cold conditions, which are air cooled, which are required to operate using a heavy fuels (including jet fuels such as kerosene, JP-5 and JP-8), and in which there are space constraints for the packaging of certain components. Accordingly, the dual fluid injection system 10 is particularly suitable for unmanned aerial vehicle (UAV) engines which may be required to operate in high altitude conditions, and snowmobile engines which may be required to operate in sub-zero ambient conditions. The dual fluid injection system 10 may, however, also be suitable for use in other applications and with other fuels (including for example gasoline and diesel fuels), as would be understood by a person skilled in the art.

The dual fluid injection system 10 comprises a liquid fuel metering device 11, a fluid delivery device 13, and apparatus 15 for conveying liquid fuel received from the metering device 11 to a location for mixing with air received from a pressurised supply to provide an air-fuel mixture for injection by the fluid delivery device 13 into a combustion space (combustion chamber) of an internal combustion engine. In the arrangement illustrated, the dual fluid injection system 10 is configured for direct injection of the air-fuel mixture into the combustion space of the engine.

In the embodiments, the liquid fuel metering device 11 comprises a fuel injector 12, and the fluid delivery device 13 comprises a delivery injector 14.

The fuel injector 12 and the delivery injector 14 operate in tandem, and the apparatus 15 provides an interface 20 between the fuel injector 12 and the delivery injector 14 to facilitate such a tandem operating arrangement.

The interface 20 establishes a flow path 21 along which a metered quantity of liquid fuel can be transported and delivered into a mixing zone 23 for mixing with a volume of air to create an air-fuel mixture.

In the embodiments described and illustrated, the flow path 21 involves a directional change by way of a turn section 25, as will be described in more detail later. This is advantageous, as it facilitates a packaging arrangement for the dual fluid injection system 10 in which the fuel injector 12 and the delivery injector 14 can operate in tandem without being directionally aligned axially. More particularly, in the embodiments described and illustrated, the directional change involves a right-angle turn facilitating assembly of the fuel injector 12 and a delivery injector 14 in a right-angle configuration. Other packaging arrangements for the dual fluid injection system 10 in which the fuel injector 12 and the delivery injector 14 can operate in tandem without being directionally aligned axially, are contemplated. In other words, the directional change may be of an appropriate form and not necessarily a right-angle turn. Further, the flow path need not necessarily involve a directional change; for example, the flow path may be straight (and not involve any directional change) in some other embodiments.

The delivery injector 14 includes a cavity 27 for receiving pressurised air.

In one arrangement, the cavity 27 provides the mixing zone 23, whereby a metered quantity of liquid fuel transported along the flow path 21 is delivered directly into the cavity 27 for mixing with a volume of air in the cavity 27 to create the air-fuel mixture. Such an arrangement is featured in the first embodiment to be described later with reference to FIGS. 1 to 8.

In another arrangement, the mixing zone 23 is separate from the cavity 27. In such an arrangement, the flow path 21 may include an extension portion which extends through the cavity 27 to establish the mixing zone 23 beyond the cavity 27. With this arrangement, the location of the mixing zone 23 can be determined by the length of the extension portion. This enables the mixing zone 23 to be positioned relatively closely to the delivery end of the delivery injector 14, thereby reducing the distance over which the air-fuel mixture must flow within the delivery injector prior to delivery into the combustion space (combustion chamber) of the internal combustion engine. Such an arrangement is featured in the second embodiment to be described below with reference to FIGS. 9 and 10.

Referring now to the first embodiment shown in FIGS. 1 to 8, the fuel injector 12 is of known type in the arrangement shown, and comprises an intake end section 31, and a delivery end section 32 defining a nozzle portion 33.

The nozzle portion 33 includes an end face 34, a delivery port arrangement 35 disposed at or adjacent the end face 34, a circumferential sealing seat 36 disposed inwardly from the end face 34, a peripheral groove 37 on the opposed side of the circumferential sealing seat 36, and a sealing O-ring 38 received in the peripheral groove 37. The latter features of the nozzle portion 33 are best seen from consideration of FIG. 4.

The nozzle portion 33 may be configured for delivery of any one of a variety of fuel plumes; for example, a pencil or linear fuel plume, a multiple stream fuel plume issuing from a multi-hole delivery arrangement, a spray or conical fuel plume.

Figure 5:
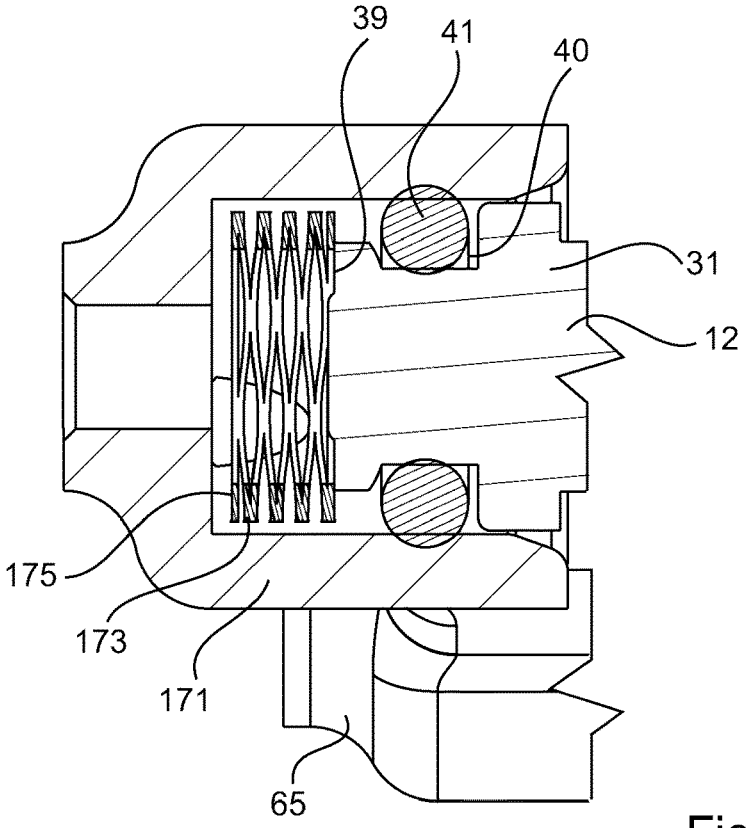
FIG. 5 is an enlarged fragmentary view of FIG. 2, illustrating in particular engagement between an intake end section of the liquid fuel metering device and the interface apparatus.

As best seen from consideration of FIG. 5, the intake end section 31 comprises an end face 39, a peripheral groove 40 disposed inwardly from the outer end face 39, and a sealing O-ring 41 received in the peripheral groove 40.

In the arrangement shown, the delivery injector 14 comprises an intake end section 42, and a delivery end section 43 defining a nozzle portion 44.

Figure 8:
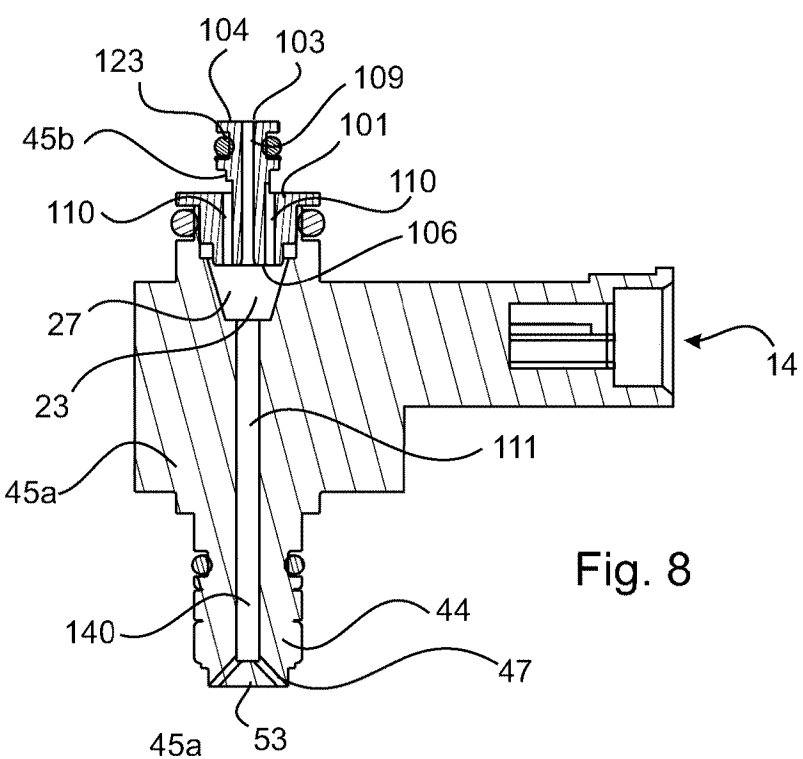
FIG. 8 is cross-sectional view of the assembly along line 8-8 of FIG. 7.
Figure 7:
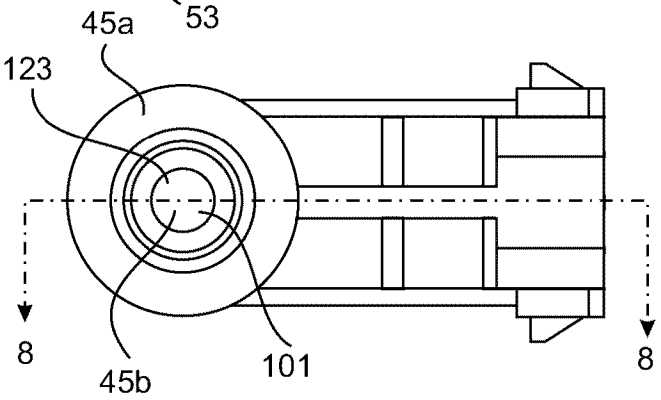
FIG. 7 is a plan view of the fluid delivery device.
Figure 6:
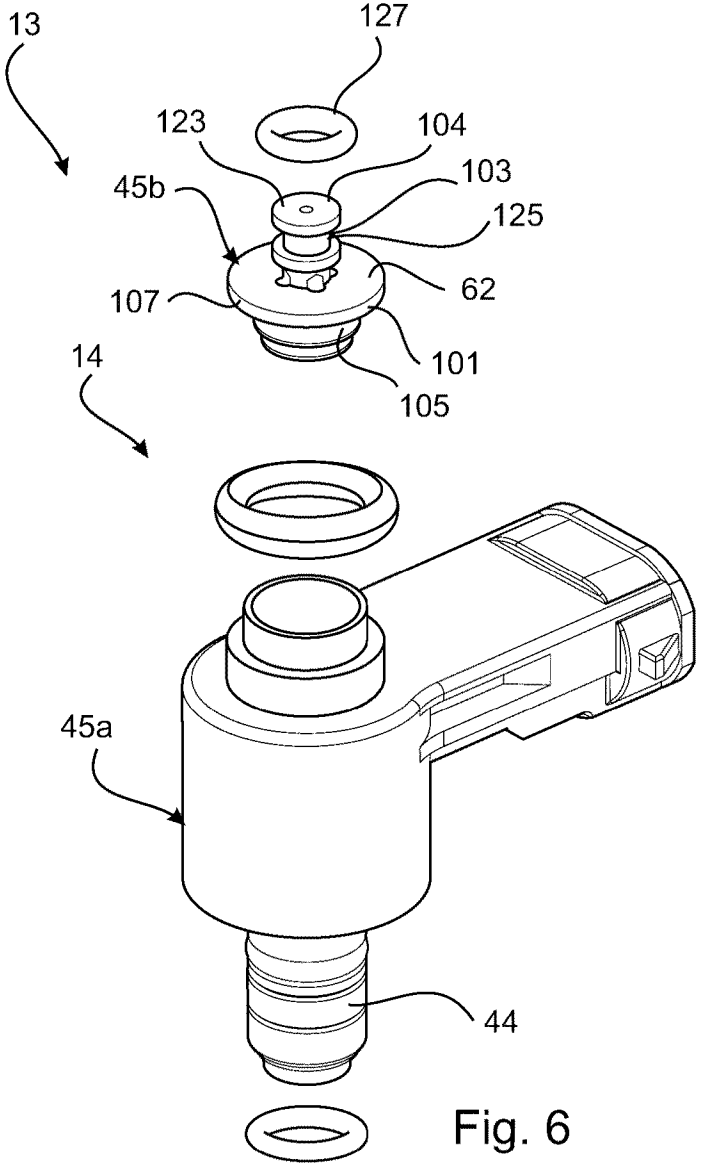
FIG. 6 is an exploded perspective view of the fluid delivery device.

As best seen from consideration of FIGS. 6 and 8, the delivery injector 14 is of two-part construction, in the sense that it comprises two main component parts adapted to be releasably connected together. The two main component parts comprise a first part defining a main body 45*a*, which includes the delivery end section 43, and a second part 45*b* defining the intake end section 42. The purpose of this two-part construction will become apparent later.

Figure 2:
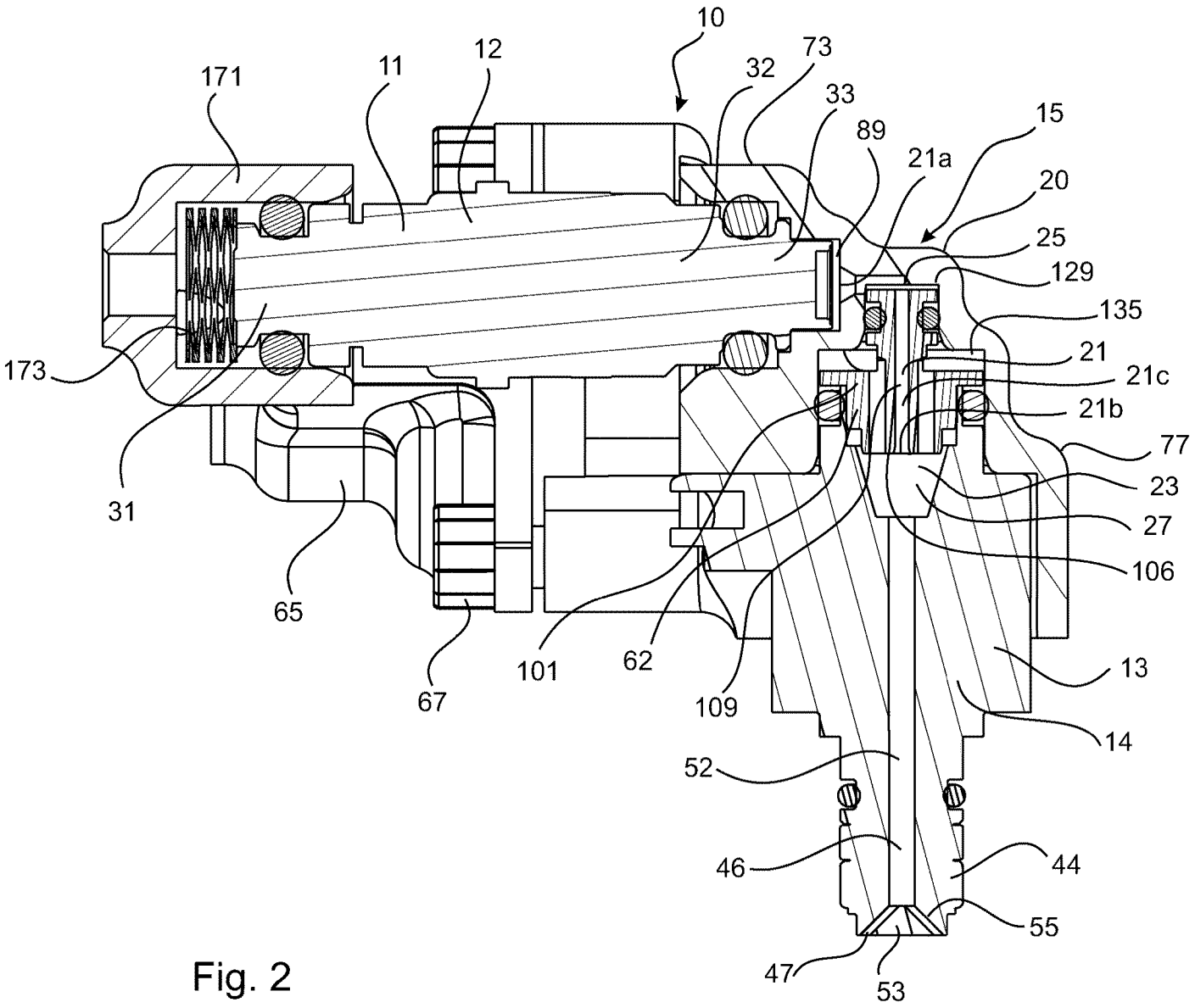
FIG. 2 is a cross-sectional view of the first embodiment in an assembled condition.

As seen in FIG. 2, the delivery injector 14 further comprises a delivery valve 46 which is in the main body 45*a* and which is associated with the nozzle portion 44. The delivery valve 46 is operable in known manner to open and close a valve port 47 in the nozzle portion 44 to control delivery of the air-fuel mixture from the delivery valve 46 and into the combustion space. In the arrangement shown, the delivery valve 46 is in the form of a poppet valve comprising a valve stem (not shown), and a valve head 53 which cooperates with a valve seat 55 formed in the nozzle portion 44 to define the valve port 47. The valve stem is hollow; more particularly, the valve stem incorporates an axial passage 52.

The delivery valve 46 and its associated features, including valve stem, valve head 53, valve seat 55 and valve port 47, are depicted schematically in the various figures for illustrative purposes only. It should be understood that the delivery valve 46 may take any other appropriate form as would be understood by a person skilled in the art.

The interface 20 between the fuel injector 12 and the delivery injector 14 may be integrated with a fuel rail forming part of a fuel system for the engine.

The interface 20 comprises a housing assembly 61 and an interface portion 62. The interface portion 62 serves to provide the second part 45*b* of the delivery injector 14 defining the intake end section 42, as will be explained in more detail later.

The interface portion 62 functions as a cap 63 which is adapted to be fitted onto the main body 45*a* to complete the two-part construction of the delivery injector 14.

The housing assembly 61 comprises a housing body 64 and a housing cap 65. The housing body 64 and the housing cap 65 are adapted to be detachably connected together by way of fasteners 67 to provide the housing assembly 61. The housing assembly 61 is adapted to accommodate a fuel regulator assembly and related components.

The housing body 64 includes a body portion having an inlet 73 incorporating an inlet portion 75, and an outlet 77 incorporating an outlet portion 79.

The inlet portion 75 is adapted to receive the nozzle portion 33 of the fuel injector 12, as will be described in more detail later. In this way, the inlet 73 can receive liquid fuel delivered by the fuel injector 12.

The outlet portion 79 is adapted to receive the delivery injector 14. More particularly, the outlet portion 79 is adapted to receive the interface portion 62 which provides the intake end section 42 of the delivery injector 14. In other words, the outlet portion 79 is adapted to receive the intake end section 42 of the delivery injector 14.

Figure 4:
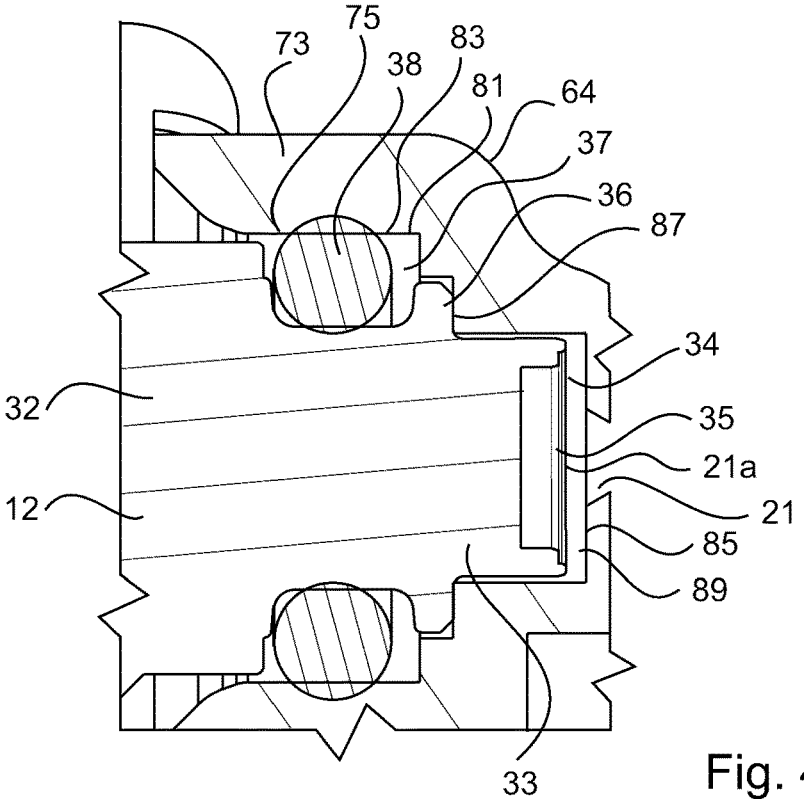
FIG. 4 is an enlarged fragmentary view of FIG. 2, illustrating in particular engagement between a delivery end section of the liquid fuel metering device and the interface apparatus.

Referring in particular to FIG. 4, the inlet portion 75 of inlet 73 comprises a socket formation 81 which can sealingly receive the nozzle portion 33 of the fuel injector 12. The socket formation 81 comprises a side wall 83 and an inner end wall 85. The side wall 83 is of stepped configuration to provide a circumferential shoulder 87 against which the circumferential sealing seat 36 of the fuel injector 12 can locate when the nozzle portion 33 is fully received in the socket formation. The arrangement is such that the end face 34 of the nozzle portion 33 of the fuel injector 12 is spaced from the inner end wall 85 of the socket formation 81 to define a space 89 when the nozzle portion 33 is fully received in the socket formation, and the sealing O-ring 38 engages against the side wall 83.

Figure 3:
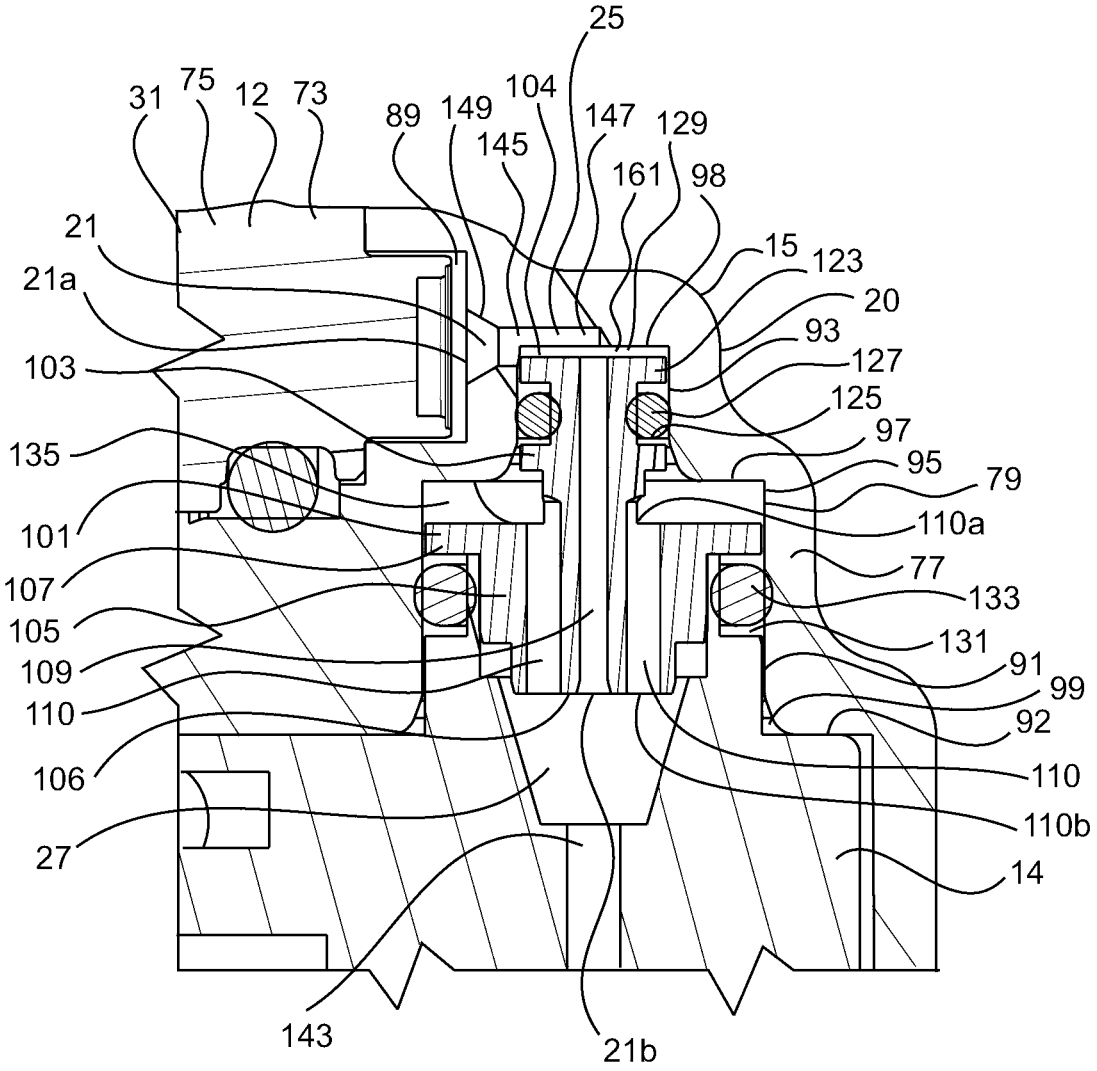
FIG. 3 is an enlarged fragmentary view of FIG. 2, illustrating in particular engagement between the interface apparatus and the fluid delivery device.

Referring now to FIG. 3 in particular, the outlet portion 79 of outlet 77 comprises a socket formation 91 extending inwardly from an external shoulder 92. The external shoulder 92 serves to limit the extent to which the delivery injector 14 can be received in the outlet portion 79.

The socket formation 91 comprises an inner section 93 and an outer section 95, with the outer section 95 being of larger diameter than the inner section 93. A step 97 is defined between the inner and outer sections 93, 95. The inner section 93 has an inner wall 98 at one end, and the other end thereof opens onto the outer section 95 adjacent the step 97. The end of the outer section 95 opposite to the step 97 provides an opening 99 bounded by the external shoulder 92.

Referring in particular to FIGS. 3, 6 and 8, the interface portion 62 comprises an annular body 101 having a first end section 103, a second end section 105 and an intermediate flange 107 therebetween. The first end section 103 terminates at first end face 104, and the second end section 105 terminates at second end face 106.

The annular body 101 also incorporates a central passage 109 extending between the two end faces 104, 106. The central passage 109 opens onto end face 106, thereby defining the outlet end 21*b* of the flow path 21. With this arrangement, liquid fuel flow along the central passage 109 discharges through outlet end 21*b* into the cavity 27 within the delivery injector 14. Liquid fuel discharging into the cavity 27 mixes with air within the cavity to create the air-fuel mixture, as will be described in more detail later. In this way, the mixing zone 23 is effectively established within the cavity 27. The annular body 101 also incorporates at least one further axial passage 110 extending between the intermediate flange 107 and end face 106. In the arrangement shown, there are two such further axial passages 110, each on opposed sides of the central passage 109. Each further axial passage 110 has an inlet end 110*a* opening onto the exterior of the annular body 101 adjacent the intermediate flange 107 on the side thereof corresponding to the first end section 103. Each further axial passage 110 has an outlet end 110*b* opening onto the end face 106 of the second end section 105. The purpose of the further axial passages 110 is to deliver air under pressure into the cavity 27, as will be described in more detail later.

The first end section 103 of the annular body 101 provides a nipple 123 adapted to be received in the inner section 93 of the socket formation 91 defining the outlet portion 79. The nipple 123 terminates at first end face 104. Further, the nipple 123 has a peripheral groove 125 disposed inwardly from the first end face 104 and a sealing O-ring 127 received in the peripheral groove 125. When the nipple 123 is fully received in the inner section 93 of the socket formation 91, the sealing O-ring 127 engages against the circular side wall of the inner section 93, as best seen in FIG. 3. Further, the arrangement is such that the first end face 104 of the nipple 123 is spaced from the inner wall 98 of the socket formation 91 to define a space 129 when the nipple 123 is fully received in the socket formation.

The intermediate flange 107 of the annular body 101 is adapted to be received in the outer section 95 of the socket formation 91 defining the outlet portion 79.

When the cap 63 provided by the interface portion 62 is fitted onto the main body 45*a* to complete the two-part construction of the delivery injector 14, the intermediate flange 107 cooperates with an adjacent portion of the main body 45*a* to define a peripheral groove 131 in which a sealing O-ring 133 is received. When the nipple 123 is fully received in the inner section 93 of the socket formation 91, the intermediate flange 107 of the annular body 101 is received in the outer section 95 of the socket formation 91 and the sealing O-ring 133 engages against the circular side wall of the outer section 95.

Further, the cap 63 is sized and shaped such that when the delivery injector 14 is received in the inner section 93 of the socket formation 91, the intermediate flange 107 is spaced from the step 97 within the socket formation 91, whereby a space 135 is defined between the intermediate flange 107 and the step 97. The space 135 is adapted to communicate with the supply of pressurized air (not shown), with air flowing from the supply through the space 135 and on to the mixing zone, as will be described in more detail later. The two further axial passages 110 in the annular body 101 open onto the space 135 by way of the inlet ends 110*a*.

Still further, the cap 63 provided by the interface portion 62 is adapted to cooperate with the main body 45*a* to define the cavity 27 within the delivery injector 14.

The two further axial passages 110 in the annular body 101 open onto the cavity 27 by way of the outlet ends 110*b*, as described previously. With this arrangement, pressurised air delivered into space 135 from the air supply can flow through the further axial passages 110 in the annular body 101 and into cavity 27 within the delivery injector 14. An air path 143 of known kind is provided within the delivery injector 14 for air flow from the cavity 27 to the nozzle portion 44 and associated delivery valve 46. Upon opening of the delivery valve 46, the air-fuel mixture is transported by fluid flow induced by the pressurised air supply through and along the hollow valve stem (not shown), and through the valve port 47 and into the combustion space of the engine.

As previously mentioned, the extent to which the delivery injector 14 can be received in the outlet portion 79 is limited by the external shoulder 92, thereby ensuring that spaces 129 and 135 are created.

The body portion 71 of the housing body 64 incorporates a passage 145 which extends from space 89 in the inlet portion 75 to a void 149 which is adjacent to the outlet portion 79. The void 149 opens onto the socket formation 91 of the outlet portion 79 through the inner wall 98.

The passage 145 comprises a first passage section 147 configured to direct liquid fuel into the passage. The first passage section 147 may be configured to match or otherwise accord with the fuel plume issuing from the fuel injector 12, thereby to guide liquid fuel into the passage 145. In the arrangement shown, the first passage section 147 is of a conical formation.

This arrangement provides for fluid flow communication between the space 89 in the inlet portion 75 and the central passage 109 within the annular body 101 of the interface portion 62, and ultimately to the mixing zone 23.

Accordingly, this arrangement establishes the flow path 21 which extends from the inlet 73 to the mixing zone 23. The flow path 21 comprises the following, in combination: passage 145 which extends from space 89 in the inlet portion 75 to void 149; space 129 defined between the inner wall 98 and the nipple 123; and the central passage 109 within the annular body 101.

The flow path 21 thus provides fluid flow communication between the space 89 in the inlet portion 75 and the central passage 109 within the annular body 101 of the interface portion 62 which opens onto the cavity 27 to provide the mixing zone 23.

The flow path 21 has inlet end 21*a* and outlet end 21*b*. The inlet end 21*a* corresponds to the location at which passage 145 opens onto space 89 in the inlet portion 75. The outlet end 21*b* corresponds to the location at which the central passage 109 in the annular body 101 opens onto end face 106.

The flow path 21 is sealed apart from the inlet end 21*a* and the outlet end 21*b*. In this way, the flow path 21 provides a hydraulic passage which is sealed in the sense that the volume of liquid fuel entering the passage is the same as the volume of liquid discharging from the passage.

The flow path 21 serves to convey liquid fuel received at the inlet end 21*a* and discharge liquid fuel at the outlet end 21*b* into the mixing zone 23. The flow path 21 is configured such that the volume of liquid fuel issuing at the outlet end 21*b* corresponds to the volume of the metered quantity of liquid fuel received at the inlet 21*a*. More particularly, the flow path 21 is configured to remain substantially full of liquid fuel between delivery cycles; that is, after each delivery of liquid fuel into the mixing zone 23. In other words, liquid fuel is retained and remains present within the flow path 21 (at least after initial priming at engine start-up). With this arrangement, the volume of liquid fuel issuing at the outlet end 21*b* is substantially equal to the volume of liquid fuel received in the flow path at the inlet end 21*a*, with the volume of liquid fuel received at the inlet end 21*a* serving to drive liquid flow along the flow path 21 and to cause a corresponding volume of liquid fuel to issue at the outlet end 21*b* of the flow path. In this way, hydraulic power is utilised to transport the liquid fuel to the mixing zone 23 for mixing with air to create the air-fuel mixture.

For this purpose, the flow path 21, or at least a portion thereof adjacent the outlet end 21*b*, is sized such that liquid fuel is retained within the flow path by virtue of capillary action. With this arrangement, the flow path 21, or at least a portion thereof adjacent the outlet end 21*b*, serves to retain a quantity of liquid fuel after a delivery event (in which liquid fuel is delivered into the mixing zone 23), such that the flow path 21 remains substantially filled with liquid fuel in readiness for the next delivery event during operation of the engine.

In this way, there is controlled delivery of liquid fuel issuing from the outlet end 21*b* of the flow path 21 into the mixing zone 23, the issuing liquid fuel comprising a volume equivalent to the metered quantity of liquid fuel received at the inlet end 21*a*. The actual quantity of fuel issuing at the outlet end 21*b* is not that which is received at the inlet 73 from the fuel injector 12, but rather is at least a portion of the actual fuel retained within the flow path 21, supplemented to the extent that may be necessary by a portion of the liquid fuel received at the inlet 73.

With this arrangement, liquid fuel introduced under pressure into the inlet end 21*a* of the flow path 21 serves to drive liquid fuel already present in the flow path along the flow path and cause a corresponding metered quantity of liquid fuel to issue at the outlet end 21*b* of the flow path for mixing with the air at the mixing zone 23 to create the air-flow mixture.

It should be understood that not all of the flow path 21 need be sized such that liquid fuel is retained within the flow path by virtue of capillary action. Rather, it may be that only a portion of the flow path 21 adjacent the outlet end 21*b* need be sized such that liquid fuel is retained within the flow path by virtue of capillary action. This is because any liquid fuel upstream of said portion would be retained in any event by virtue of the plugging effect provided by the liquid fuel retained at said portion by capillary action.

In this embodiment, it is only portion 21*c* of the flow path 21 adjacent the outlet end 21*b* that is sized such that liquid fuel is retained within the flow path by virtue of capillary action. In the arrangement shown, portion 21*c* corresponds to the central passage 109 within annular body 101. With this arrangement, portion 21*c* of the flow path 21 retains what could be considered to be a column of liquid fuel.

Typically, the volume of fuel retained in the flow path 21 would be in the order of about 30 $mm^3$ to 100 $mm^3$. In the arrangement shown for this embodiment, the volume of fuel retained in the flow path 21 is about 60 $mm^3$.

In this embodiment, portion 21*c* of the flow path 21 is sized to have an internal diameter of less than about 1.0 mm in order to achieve the required liquid retention by virtue of capillary action. It is believed that internal diameters in the range of about 0.6 to 0.9 mm are likely to be advantageous, with a diameter of 0.8 mm to 0.85 mm being particularly suitable. In this embodiment, the actual internal diameter is 0.826 mm plus or minus 0.025 mm. These dimensions and ranges are provided for illustrative purposes only, and are not necessarily intended to be limiting, as actual sizing may vary according to the intended application of the fuel injection system 10 and the particular fuel intended to be used. For example, a larger diameter may be chosen for an application where a more viscous fluid is to be delivered or where a higher flow requirement may exist for the fuel injector.

Broadly, it is believed that the internal diameter at the exit end of the portion 21*c* of the flow path 21 would typically be less than 1.0 mm for a small engine, and typically be less than 1.2 mm for a larger engine, with a so-called small engine being considered to be one having a capacity of less than 100 cc per cylinder and a so-called larger engine being one having a capacity of up to about 650 cc per cylinder.

While the flow path 21 is sized to achieve the desired capillary action for retaining liquid fuel as described, it is also desirable that the flow path 21 be sized appropriately to avoid, or at least minimise, back-pressure which could adversely affect delivery of liquid fuel from the fuel injector 12. In this regard, it is important to avoid a condition which might change the delivery of liquid fuel from the fuel injector 12, as this can adversely affect reliability and predictably of liquid fuel metering. In other words, the capillary action is not used for flow control. Rather, the capillary action is used in the delivery of a prescribed volume of liquid fuel to the mixing zone 23 for mixing with air.

There may be a need for priming of the dual fluid injection system 10 for starting of the internal combustion engine. Accordingly, the volume of the flow path 21 may be selected to reduce the initial number of engine cycles required to prime the system; that is, the volume of the flow path 21 may be minimised to reduce the initial number of engine cycles required for priming.

It is a feature of the flow path 21 extending from the inlet 73 to the mixing zone 23 that it need not be axial. Indeed, in this embodiment the flow path 21 involves a directional change. In the arrangement illustrated, the directional change comprises turn section 25, as best seen in FIG. 3. The turn section 25 comprises the intersection at void 149 of passage 145 extending from space 89 in the inlet portion 75 and the central passage 109 within the annular body 101. In the arrangement illustrated, the turn section 25 involves a right-angle turn. Other arrangements are, of course, possible. By way of example, the flow path 21 may be defined within a body formed (such as by casting) to provide a continuous hydraulic passage which provides the flow path, with the continuous hydraulic passage being integrated into the body. In such an arrangement, the turn section may be curved and integrated into the body.

The provision of a directional change in the flow path 21 facilities an arrangement in which the fuel injector 12 and the delivery injector 14 are angularly offset with respect to each other (as is the case in the present embodiment, which is best seen in FIG. 2). This is in contrast to a conventional arrangement featuring a fuel injector and a delivery injector axially aligned and operating in tandem, with the fuel injector "piggybacked" onto the delivery injector.

As alluded to above, the fuel injector 12 is supported by the housing assembly 61. In particular, the nozzle portion 33 defined by the delivery end section 32 of the fuel injector 12 is received in the inlet portion 75 of the housing body 64 of the housing assembly 61, as best seen in FIG. 4. The intake end section 31 of the fuel injector 12 is received in a housing portion 171 incorporated in the housing cap 65 of the housing assembly 61, as best seen in FIG. 5.

The housing portion 171 defined by the housing cap 65 of the housing assembly 61 incorporates a retainer in the form of a spring 173 acting between an adjacent shoulder 175 of the housing portion and end face 39 of the intake end section 31 of the fuel injector 12, as best seen in FIG. 5. The spring 173 is operable to resiliently urge the nozzle portion 33 of the fuel injector 12 into the inlet portion 75 of the housing body 64, with the nozzle portion 33 being seated within the inlet portion 75 by virtue of the circumferential sealing seat 36 of the fuel injector 12 locating against the circumferential shoulder 87 within the inlet portion 75. Cooperation between the spring 173 acting upon the fuel injector 12 and the fuel injector 12 itself being seated within the inlet portion 75, serves to prevent axial movement of the fuel injector 12 with respect to the housing assembly 61. This arrangement is advantageous, as it is most desirable to prevent axial movement of the fuel injector 12 when it is actuated to deliver a metered quantity of liquid fuel. Preventing axial movement of the fuel injector 12 with respect to the housing assembly 61 ensures that the volume between the nozzle portion 33 of the fuel injector 12 and the outlet end 21*b* of the flow passage 21 remains constant during the metering and delivery of liquid fuel through the flow path 21. Restricting axial movement of the fuel injector 12 when actuated is conducive to reliability and repeatability of fuel metering events, thereby ensuring consistency in operation of the fuel injection system 10. This consistency also contributes to enhanced response in so far as engine speed transients are concerned and the ability to maintain constant air fuel distributions during injection events.

In this embodiment, the spring 173 comprises a wave spring. However, other types of springs are contemplated, including for example a coil spring or an elastomeric spring element.

The opportunity to limit axial movement of the fuel injector 12 when it is actuated to deliver a metered quantity of liquid fuel arises with the present embodiment because of the presence of the space 89 in the inlet portion 75 ahead of the nozzle portion and the passage 145 extending from the space. The arrangement allows the space 89 to be relatively small, as there is no mixing with air at this point, and the space merely provides a transition volume to receive liquid fuel issuing from of the fuel injector 12, without creating adverse back-pressure, and to direct the issuing liquid fuel into the flow path 21. In contrast, with prior art arrangements in which liquid fuel issuing from the fuel injector is immediately mixed with air, there is a need for a much larger volume ahead of the fuel injector to accommodate the issuing fuel and the associated air flow required to entrain the liquid fuel and create the air-fuel mixture. In particular, there was a need with prior art arrangements to avoid any restriction to flow from the fuel injector during a liquid fuel metering event, hence the need for the larger volume. The manner in which the fuel injector is mounted in position in prior art arrangements to establish the requisite larger volume meant that there was not the same opportunity to limit axial movement of the fuel injector when it is actuated to deliver a metered quantity of liquid fuel.

With this embodiment of the fuel injection system 10, the liquid fuel is not mixed with air immediately upon leaving the fuel injector 12; rather, mixing occurs distal to the fuel injector 12 at the mixing zone 23 which is spaced from the fuel injector. This arrangement can offer various benefits, as outlined below.

One benefit is that the flow path 21 between the fuel injector 12 and the distal mixing zone 23 can incorporate one or more directional changes (as is the case with the present embodiment where one directional change is involved). This facilitates offsetting between the fuel injector 12 and the delivery injector 14, which lends itself to various packaging opportunities.

A further benefit is that the fuel injection system 10 provides for a hydraulic path from the fuel injector 12 to the delivery injector 14. That is, the liquid fuel flowing along flow path 21 is driven by liquid inflow (that is, propelled by hydraulic power by virtue of the liquid inflow), rather than being entrained in an air flow. This can be particularly significant in cases where there is a directional change in the flow path 21. In circumstances where liquid fuel is required to be conveyed along a flow path entrained in air, there can be a high air demand to transport and scavenge fuel through a directional change such as around a turn section (e.g. a corner or bend). This requisite high air demand might not necessarily be available for certain engines and applications, such as those related to UAVs. This issue is avoided in the present arrangement by use of hydraulic power to transport liquid fuel around a turn section.

A still further benefit is that the fuel injection system 10 enables the delivery of the liquid fuel and the air to be completely separated until the fuel is deposited into the mixing zone 23 of the delivery injector. That is, the liquid fuel can be delivered to the mixing zone 23 without contact with air, thereby avoiding problems associated with certain prior art arrangements including "wall wetting" and "fuel hang-up" arising with transport of liquid fuel entrained in pressurized air.

In operation of the present embodiment to perform an injection event, actuation of the fuel injector 12 delivers a metered quantity of liquid fuel into the apparatus 15, and more particularly into the space 89 within the inlet portion 75 ahead of the nozzle portion 33 of the fuel injector. As a consequence of an earlier priming action or the immediately preceding injection event, the flow path 21 is at this stage filled with retained liquid fuel. Accordingly, liquid fuel delivered under pressure upon actuation of the fuel injector 12 enters the flow path 21 through the inlet end 21*a* and drives liquid flow along the flow path, causing a corresponding quantity of liquid fuel to issue at the outlet end 21*b* of the flow path and to then enter the mixing zone 23. In this way, hydraulic power is utilised to transport the liquid fuel to the mixing zone 23 for mixing with air to create the air-fuel mixture. Air is available at the mixing zone 23 from the air supply, the air being delivered into space 135 from the air supply and flowing through the further axial passages 110 in the annular body 101 into cavity 27 within the delivery injector 14, along air path 143 within the delivery injector 14 to the nozzle portion 44 and associated delivery valve 46. The air-fuel mixture is delivered by the delivery injector 14 upon opening of the delivery valve 46, whereby fluid flow induced by the pressurised air supply transports the air-fuel mixture into the combustion space in a similar manner to the Applicant's prior art dual fluid injection systems, and as would be understood by a person skilled in the art.

With this arrangement, the liquid fuel is delivered to the mixing zone 23 by hydraulic power, without prior contact with or entrainment in air. This provides various benefits in comparison to certain prior art arrangements, as discussed above, including in particular enabling the provision of an offset arrangement between the fuel injector 12 and the delivery injector 14.

Further, the arrangement allows for the use of any type of fuel injector 12 as part of the fuel injection system. This is because of the way in which the fuel injector 12 is retained in the housing assembly 61. By way of example, the arrangement can accommodate a fuel injector featuring a pencil or linear fuel plume, a multiple stream fuel plume issuing from a multi-hole delivery arrangement, a spray or conical fuel plume. This is advantageous as it may greatly simplify the selection of the fuel injector.

Figure 9:
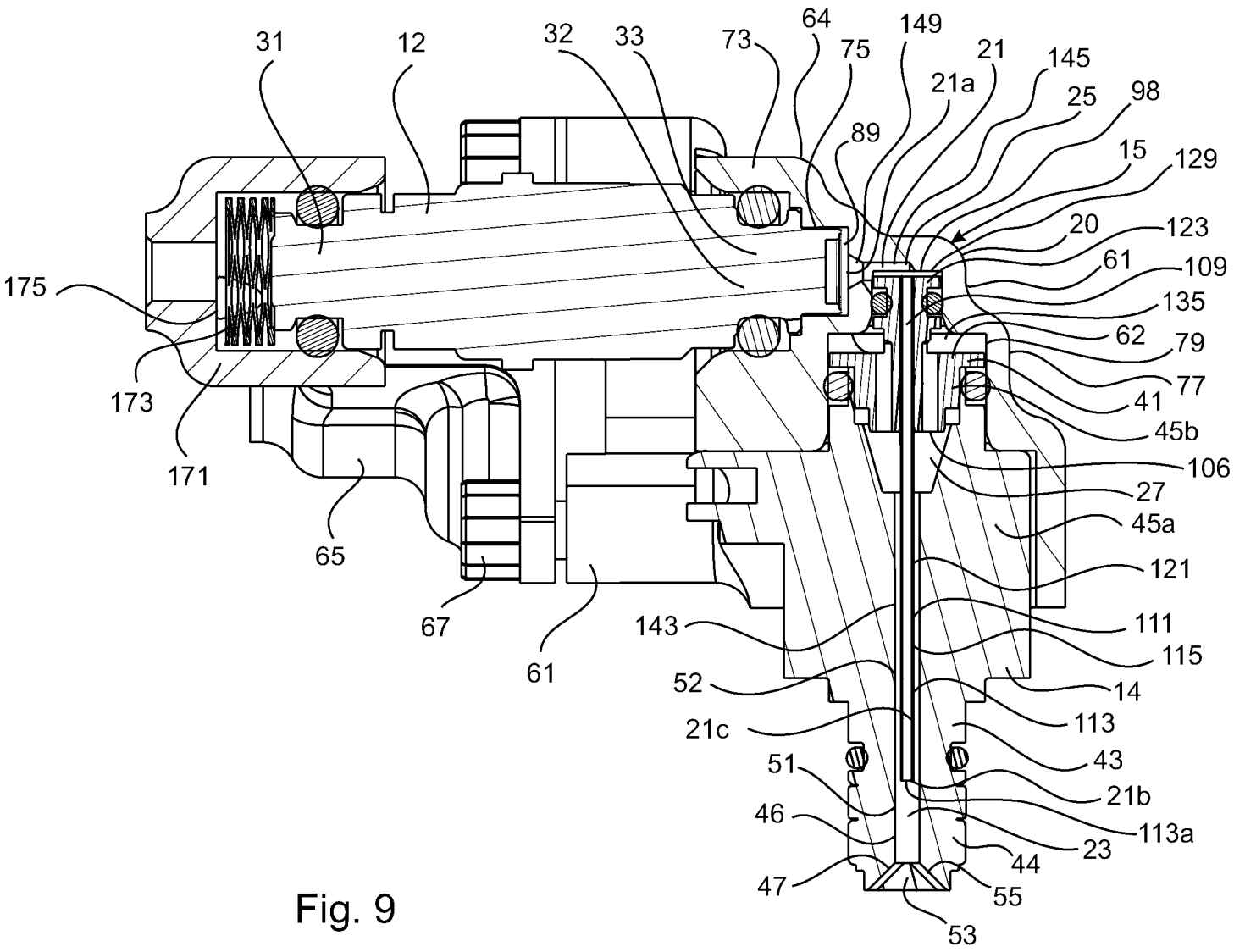
FIG. 9 is a cross-sectional view of a second embodiment featuring an assembly comprising a liquid fuel metering device, a fluid delivery device, and an interface apparatus.
Figure 10:
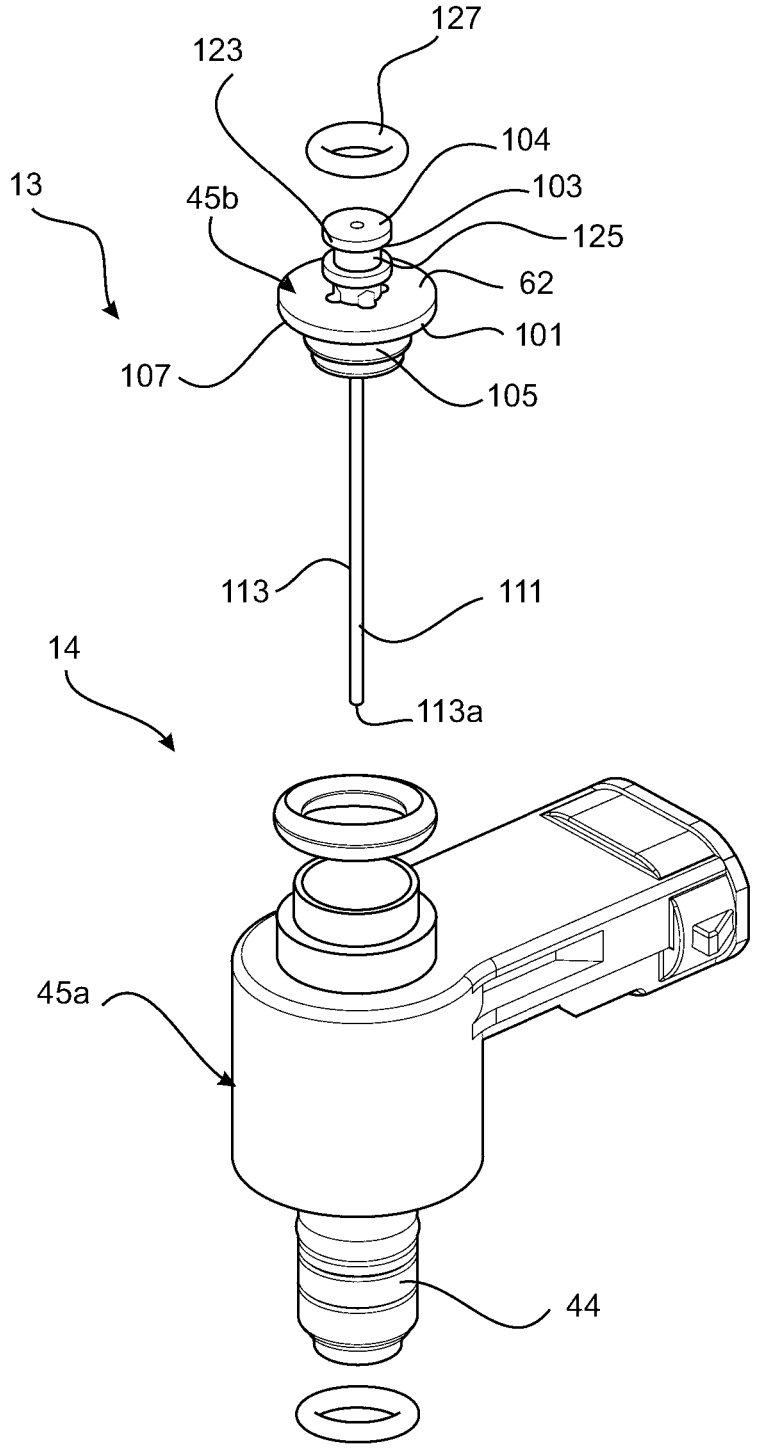
FIG. 10 is an exploded perspective view of the fluid delivery device featured in the second embodiment as shown in FIG. 9.

Referring now to FIGS. 9 and 10, there is shown apparatus 15 according to a second embodiment which is similar in many respects to the previously described apparatus according to the first embodiment, and so similar reference numerals are used to identify similar parts.

In this second embodiment, the interface portion 62 further comprises an extension portion 111 configured as a slender extension tube 113 having an axial passage 115. The extension portion 111 is mounted on the annular body 101 and projects axially from the second end face 106 in alignment with the central passage 109 such that the axial passage 115 provides an uninterrupted extension of the central passage 109, as best seen in FIG. 9. In other words, the central passage 109 and the axial passage 115 cooperate to provide a continuous passage 121 within the interface portion 62. The purpose of the extension portion 111 will be explained later.

In this embodiment, the slender extension tube 113, which is mounted on the annular body 101 and which forms part of the interface portion 62, extends through the cavity 27 and into the axial passage 52 within the hollow valve stem (not shown) of the delivery valve 46. With this arrangement, the location at which the terminal end 113*a* of the extension tube 113 is disposed within the delivery injector 14 determines the position of, and also establishes, the mixing zone 23.

The flow path 21 thus provides fluid flow communication between the space 89 in the inlet portion 75 and the central passage 109 within the annular body 101 of the interface portion 62. In this embodiment, such communication also extends to the mixing zone 23 by way of the extension portion 111 through the axial passage 115 in the extension tube 113.

Accordingly, this arrangement establishes the flow path 21 which extends from the inlet 73 to the mixing zone 23. The flow path 21 comprises the following, in combination: passage 145 which extends from space 89 in the inlet portion 75 to void 149; space 129 defined between the inner wall 98 and the nipple 123; and the central passage 109 within the annular body 101; and axial passage 115 in the extension tube 113.

The flow path 21 has inlet end 21*a* and outlet end 21*b*. The inlet end 21*a* corresponds to the location at which passage 145 opens onto space 89 in the inlet portion 75. The outlet end 21*b* corresponds to the terminal end 113*a* of the extension tube 113, at which the axial passage 115 in the extension tube opens onto the mixing zone 23.

The mixing zone 23 is located within the air path 143 within the delivery injector 14, at the location within the air path at which the terminal end of the extension tube 113 is positioned.

In this embodiment, it is only portion 21*c* of the flow path 21 adjacent the outlet end 21*b* that is sized such that liquid fuel is retained within the flow path by virtue of capillary action. In the arrangement shown, that portion 21*c* corresponds to the continuous passage 121 within the interface portion 62, comprising the central passage 109 within annular body 101 and the axial passage 115 within the extension tube 113. With this arrangement, portion 21*c* of the flow path 21 retains what could be considered to be a column of liquid fuel.

In the arrangement shown for this embodiment, the volume of fuel retained in the flow path 21 is about 75 $mm^3$.

Rather than the central passage 109 within annular body 101 and the axial passage 115 within the extension tube 113 both being sized such that liquid fuel is retained within the flow path by virtue of capillary action, as is the case in this embodiment, it may be that only the axial passage 115 within the extension tube 113 need be sized to retain liquid fuel within the flow path 21 by virtue of capillary action. This is because any liquid fuel upstream of the extension tube 113 would be retained by virtue of the plugging effect provided by the liquid fuel retained within the extension tube 113 by capillary action.

With this embodiment, the location of the mixing zone 23 can be selectively varied; for example, by selection of the length of the extension tube 113 to accord with the desired location of the mixing zone 23. This enables the mixing zone 23 to be positioned relatively closely to the valve port 47 of delivery valve 46 (as is the case in the present embodiment), thereby reducing the distance over which the air-fuel mixture must flow to the delivery port. This may be beneficial in reducing the extent of wetted surface to which the flowing air-fuel mixture is exposed, and also the associated potential for "fuel hang-up".

It is a feature of the two embodiments described and illustrated that capillary action is used to deliver liquid fuel to a desired location for mixing with air. In this way, the liquid fuel can be delivered to the mixing location without prior contact with air, thereby avoiding problems associated with certain prior art arrangements including "wall wetting" and "fuel hang-up" arising with transport of liquid fuel entrained in pressurized air, as previously discussed.

It is a further feature of the two embodiments described and illustrated that the capillary action facilitates transportation of a metered quantity of liquid fuel along a flow path of any configuration, including one involving directional change such as by way of having one or more turn sections. This is advantageous as it facilitates a packaging arrangement in which a fuel injector and a delivery injector are operable in tandem without necessarily being directionally aligned axially. In particular, the fuel injector and a delivery injector may be assembled in, for example, a right-angle configuration as is the case with the arrangements shown in the drawings.

It is notable that in the embodiments described and illustrated, the capillary action is not being used for flow control. Rather, the capillary action is being used in the delivery of a prescribed volume of liquid fuel to a desired location for mixing with air.

In the two embodiments described and illustrated, the flow path 21 features a directional change. However, the flow path need not necessarily do so. In another embodiment, the flow path may be straight; for example, the flow path may comprise an axial passage. With this arrangement, the inlet end and the outlet end of the flow path would be axially aligned.

It should be appreciated that the scope of the invention is not limited to the scope of the two embodiments described. Modifications and variations such as would be apparent to the skilled addressee are considered to fall within the scope of the present invention.

The present disclosure is provided to explain in an enabling fashion the best modes of making and using various embodiments in accordance with the present invention. The disclosure is further offered to enhance an understanding and appreciation for the invention principles and advantages thereof, rather than to limit in any manner the invention. While a preferred embodiment of the invention has been described and illustrated, it is clear that the invention is not so limited. Numerous modifications, changes, variations, substitutions, and equivalents will occur to those skilled in the art having the benefit of this disclosure without departing from the spirit and scope of the present invention as defined by the following claims.

Reference to positional descriptions, such as "inner", "outer", "upper", "lower", "top" and "bottom", are to be taken in context of the embodiments depicted in the drawings, and are not to be taken as limiting the invention to the literal interpretation of the term but rather as would be understood by the skilled addressee.

Additionally, where the terms "system", "device", and "apparatus" are used in the context of the invention, they are to be understood as including reference to any group of functionally related or interacting, interrelated, interdependent or associated components or elements that may be located in proximity to, separate from, integrated with, or discrete from, each other.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. An apparatus for mixing a liquid fuel with air in a dual fluid direct injection system for an internal combustion engine, the apparatus comprising an inlet for receiving a metered quantity of liquid fuel from a liquid fuel metering device comprising a fuel injector, a flow path extending from the inlet for transporting liquid fuel received from the fuel injector at the inlet to a mixing zone at which liquid fuel is admitted into a volume of air to create an air-fuel mixture, the flow path having an inlet end communicating with the inlet and an outlet end communicating with the mixing zone to convey liquid fuel received at the inlet end and to discharge liquid fuel at the outlet end into the mixing zone, wherein a volume of liquid fuel discharged at the outlet end of the flow path corresponds to a volume of the metered quantity of liquid fuel received at the inlet end of the flow path wherein the flow path retains liquid fuel therein by capillary action whereby the flow path remains substantially filled with liquid fuel between delivery cycles, and wherein the flow path comprises a directional change between the inlet end and the outlet end downstream of the fuel injector.

2. The apparatus according to claim 1 wherein the mixing zone communicates with a fluid delivery device, whereby the fluid delivery device is operable to deliver the air-fuel mixture directly into a combustion space of the engine.

3. The apparatus according to claim 2 further comprising an outlet for communication with the fluid delivery device, wherein the outlet comprises an outlet portion which receives the fluid delivery device.

4. The apparatus according to claim 3 wherein the fluid delivery device comprises a delivery injector and the liquid fuel metering device comprises a fuel injector.

5. The apparatus according to claim 3 further comprising a body defining the inlet portion, the outlet portion and the flow path.

6. The apparatus according to claim 1 wherein the mixing zone is defined wholly or in part by the fuel delivery device.

7. The apparatus according to claim 1 wherein the flow path is sealed, apart from the inlet end and the outlet end.

8. The apparatus according to claim 1 wherein the directional change in the flow path between the inlet end and the outlet end comprises a turn section within the flow path.

9. The apparatus according to claim 1 wherein the inlet for receiving a metered quantity of liquid fuel comprises an inlet portion which receives the liquid fuel metering device.

10. The apparatus according to claim 9 further comprising a retainer for releasably retaining the liquid fuel metering device with respect to the inlet portion, and wherein the retainer comprises a spring operable to bias the liquid fuel metering device into engagement with the inlet portion.

11. The apparatus according to claim 9 wherein the liquid fuel metering device comprises a nozzle portion which is received in the inlet portion, and wherein the inlet portion provides a space defined between the inlet end of the flow path and the nozzle portion of the liquid fuel metering device when the nozzle portion is received and retained within the inlet portion.

12. The apparatus according to claim 11 wherein the liquid fuel metering device is operable to deliver liquid fuel into the space, from where it can flow into the flow path via the inlet end.

13. A dual fluid direct injection system comprising a liquid fuel metering device comprising a fuel injector, a fluid delivery device, and an apparatus for mixing a liquid fuel with air, the apparatus comprising an inlet for receiving a metered quantity of liquid fuel from the fuel injector of the liquid fuel metering device, a flow path extending from the inlet for transporting liquid fuel received at the inlet to a mixing zone at which liquid fuel is admitted into a volume of air to create an air-fuel mixture for delivery by the fluid delivery device, the flow path having an inlet end communicating with the inlet and an outlet end communicating with the mixing zone to convey liquid fuel received at the inlet end and to discharge liquid fuel at the outlet end into the mixing zone, wherein a volume of liquid fuel discharged at the outlet end of the flow path corresponds to a volume of the metered quantity of liquid fuel received at the inlet, wherein the flow path retains liquid fuel therein by capillary action whereby the flow path remains substantially filled with liquid fuel between delivery cycles, wherein the flow path comprises a directional change between the inlet end and the outlet end downstream of the fuel injector, wherein the apparatus provides an interface between the liquid fuel metering device and the fluid delivery device.

14. The dual fluid injection system according to claim 13 wherein the fluid delivery device is operable to retain the air-fuel mixture and to deliver the air-fuel mixture into the combustion space; and wherein the mixing zone is incorporated within the fluid delivery device whereby liquid fuel is mixed with pressurized air to create the air-fuel mixture within the confines of the fluid delivery device, and wherein the flow path comprises an interface portion extending into the fluid delivery device.

15. The dual fluid injection system according to claim 14 wherein the interface portion further comprises an extension portion extending further into the fluid delivery device to define the location of the mixing zone.

16. The dual fluid injection system according to claim 15 wherein the extension portion comprises a slender extension tube, and wherein the extension tube is received in and extends along a hollow stem of the fluid delivery device.

17. A method of fueling an internal combustion engine, the method comprising providing a flow path having an inlet end, an outlet end and a directional change between the inlet end and outlet end, the flow path retaining liquid fuel therein by capillary action whereby the flow path remains substantially filled with liquid fuel between delivery cycles, delivering a metered quantity of liquid fuel to the flow path at the inlet end, the volume of liquid fuel received at the inlet end serving to drive liquid flow along the flow path and to cause a corresponding volume of liquid fuel to issue at the outlet end of the flow path.

18. A method of fueling an internal combustion engine, the method comprising transporting a quantity of liquid fuel metered by a liquid fuel metering device comprising a fuel injector around a turn section to an outlet end of a flow path retaining liquid fuel therein by capillary action whereby the flow path remains substantially filled with liquid fuel between delivery cycles, discharging the metered quantity of liquid fuel at the outlet end for mixing with pressurized air to create an air-fuel mixture, and delivering the air-fuel mixture into a combustion space.

19. The method according to claim 18 wherein the step of transporting a metered quantity of fuel around a turn section to an outlet end of a flow path comprises introducing fuel under pressure into an inlet end of the flow path for flow along the flow path around the turn section to the outlet end, the fuel introduced under pressure into an inlet end of the flow path emanating from a liquid fuel metering device operable to discharge a metered quantity of liquid fuel, the discharged metered quantity of liquid fuel driving liquid flow along the flow path and causing a corresponding metered quantity of liquid fuel to issue at the outlet end of the flow path for mixing with the air to create the air-flow mixture.

* * * * *